US009107467B2

(12) United States Patent
Mateu Codina

(10) Patent No.: US 9,107,467 B2
(45) Date of Patent: Aug. 18, 2015

(54) HANDS-FREE DEVICE

(76) Inventor: Xavier Mateu Codina, Barcelona (ES)

( * ) Notice: Subject to any disclaimer, the term of this patent is extended or adjusted under 35 U.S.C. 154(b) by 466 days.

(21) Appl. No.: 13/502,031

(22) PCT Filed: Oct. 19, 2010

(86) PCT No.: PCT/ES2010/070671

§ 371 (c)(1),
(2), (4) Date: Apr. 13, 2012

(87) PCT Pub. No.: WO2011/048250

PCT Pub. Date: Apr. 28, 2011

(65) Prior Publication Data

US 2012/0196538 A1 Aug. 2, 2012

(30) Foreign Application Priority Data

Oct. 19, 2009 (ES) ..... 200930867
Oct. 18, 2010 (ES) ..... 201031529

(51) Int. Cl.
*H04M 1/00* (2006.01)
*A42B 3/30* (2006.01)

(52) U.S. Cl.
CPC ..... *A42B 3/30* (2013.01)

(58) Field of Classification Search
USPC ..... 455/456.1–456.6; 340/825.72; 704/226; 381/122
See application file for complete search history.

(56) References Cited

U.S. PATENT DOCUMENTS

2005/0190047 A1* 9/2005 Lemke ..... 340/435
2009/0085766 A1* 4/2009 Seydoux et al. ..... 340/825.72
2011/0136547 A1* 6/2011 Espersen et al. ..... 455/569.1
2012/0029912 A1* 2/2012 Almagro ..... 704/226

* cited by examiner

*Primary Examiner* — Mazda Sabouri
(74) *Attorney, Agent, or Firm* — Dowell & Dowell, P.C.

(57) ABSTRACT

The invention relates to a device of the type commonly known on the market as "hands-free", i.e. devices that do not require input from the hands (fingers) in order to function, which has the essential feature of the device being installed, in one of the preferred embodiments thereof, inside a helmet, this embodiment applying to persons driving a vehicle with two or more wheels, to cyclists, skiers and other users of any type of helmet. Furthermore, the device of the invention may be used, in addition to being used for communication between passengers in the same vehicle, for communication between passengers in different vehicles or as a means of communication between two users who are walkers, cyclists or participants in other sports.

17 Claims, 5 Drawing Sheets

HANDS-FREE DEVICE

OBJECT OF THE INVENTION

The invention refers to a device of the type commonly known on the market as "hands-free", i.e. devices that do not require input from hands (fingers) in order to function, with the essential feature of the device being that in one of the preferred embodiments, it is installed inside a helmet of any kind, i.e. it is universal and does not require any modification of the helmet or any addition of complementary parts for its installation, this embodiment applying to persons driving a vehicle with two or more wheels, cyclists, skiers and other users of any type of helmet.

Alternatively, the same device, without modification of any kind, may incorporated to the user's head, using an elastic band, for practicing athletics, hiking, & other activities for instance.

Furthermore, the invention introduces improvements so that the "hands-free device" may be used, in addition to communication between passengers in the same vehicle, for communication between passengers in different vehicles separated by a certain distance.

In addition, another of the aims of the present invention is that the hands-free device can be used as a means of communication between two users hiking, cycling or practicing other sports.

STATE OF THE ART

On the market there are, and therefore can be considered as the closest state of the art to this invention, a wide range of devices that receive calls in vehicles with two or more wheels, which need to be suitably integrated into the mandatory helmet, comprising basically two parts, the main part being the earphones and the microphone which are integrated into the helmet.

Some of the known devices use earphones which are inserted into the ear canal, and therefore they are cumbersome to insert and remove as well as possibly limiting the reception of other sounds that need to be heard while riding or practicing the activity in question.

SCOPE OF THE INVENTION

The design of a versatile and universal device for use with a helmet or without, easy to fit and use.

Fitted on the inside of any type of helmet, which avoids distributors and specialist shops needing to have numerous stocks, and thus a high investment, as a result the production runs and units produced can be larger and the final retail price lower.

When fitted, there is no need for any module external to the helmet and therefore is easier to use. More convenient for the user, as both the transmitting antenna and all the hardware are incorporated into the same module of the hands-free device, using one or two speakers, without any extra module, being powered by one or two batteries.

Earphones inserted into the ear canal are not used and it incorporates a microphone close to the mouth, connected by a cable.

The on/off and sound volume adjustment controls are contained in a multi-position switch and connected to the main unit through a multicore cable and a connector, and alternatively to a remote control on the handlebar, connected to the helmet via radio link.

Due to the thinness of the device, it is very comfortable to use with a helmet, in contrast to existent hands-free devices that are much thicker and cannot be used inside a helmet.

Another of the aims of the invention is to enable the use and commercialisation of this hands-free device for sports activities, whether the sport requires wearing a helmet (e.g., cycling, skiing and any other type of sport using a helmet) or not, for instance for running, trekking or others.

Alternatively, when a helmet is not necessary, the hands-free device can have a securing system such as an elastic band round the head.

Anther aim of the invention is to incorporate, without changing the aforementioned basic features of the hands-free device, other important features that do not modify the format of the device but do enable additional functions not included in the main version.

The users of these types of hands-free devices are two-wheel vehicle passengers as well as people practicing other sports individually, who can only communicate when travelling in the same vehicle, in the case of individuals alone, they cannot communicate. Hence, the present invention includes this possibility: Vehicle passengers will be able to communicate with passengers in other vehicles, and people using this device but not riding on the vehicle, as well, alternating this possibility without limiting the aforementioned functions.

DESCRIPTION OF THE INVENTION

In a first possible embodiment of the invention, the hands-free device has a main unit that incorporates a flat loudspeaker, an antenna, and the corresponding electronics for operation and functions, with the aid of the corresponding connectors, switches and push buttons and powered by one or two batteries.

The main unit also has a connector (jack type) to connect a control module, which includes a multi-position switch that controls activation (ON/OFF), volume and other functions.

In an alternative variant of the first embodiment of the invention, the hands-free device incorporates control module that is physically detached from the main unit, fitted to the handlebar of the vehicle and radio-linked to the main unit.

The main unit normally incorporates a rigid rod, this rod is joined to the unit by one of its ends, and it has a microphone on the opposite end. A twin core cable runs inside the rod to connect the main unit to the microphone.

Finally, and to facilitate the installation of the device, the loudspeaker has Velcro or other adherent textile material on one of its sides, so it can be fitted to the helmet by simple pressure.

If the user of the vehicle of two or more wheels uses a full-face helmet, the rod can be done away with, and the microphone will be fitted to the frontal part of the helmet with Velcro type adherent material near the mouth of the user and connected with a twin core cable to the main unit with a connector.

Alternatively, according to a second embodiment of the invention, and when the hands-free device uses two speakers, the second is connected to the first with a twin core cable, using a jack-type connector for the input to the speakers.

The most important characteristics of the two aforementioned embodiments is the incorporation of all the electronics of the device in the main unit, so that the device does not require any other element for its operation, neither inside nor outside the helmet, only the mobile phone, MP3, navigator, and GPS or other devices which may be typically in the user's pocket.

Regarding the electronics incorporated into the equipment, the first and second embodiment of the invention will use wireless Bluetooth technology for communication (preferably v2.1 specification or superior). In other possible embodiments of the device, and with the aim of using the car stereo, which has two speakers in some configurations, it will also incorporate A2DP technology ("*Advanced Audio Distribution Profile*", protocol which allows the transmission of a stereo Blue-Tooth audio signal).

Other possible variations of the device may incorporate an extra wireless chip enabling communication using a closed protocol with other devices such as: other units of the same device (for the communication between motorcyclists or other users without needing to use a mobile phone); control devices such as a remote control fitted to the handlebar of the motorcycle (As described in patent P200930534). Other devices that currently exist on the market such as "TWIINS RCR PLUS" or even "TWIINS" by the addition of a DETA type backpack, Audio Transmitter Device, fitted to said "TWIINS" device.

A third possible embodiment of the invention contemplates a new configuration of the left-hand side box, being slightly larger and comprising the left-hand speaker and all the electronics of the hands-free device: The batteries, and the electronic circuit board, with a flexible tube or hose with a microphone on its end emerging form this box, and the left-hand side box connected via a cable to a charger connector.

In this third embodiment of the invention, the hose has an upgraded microphone on its end that incorporates before the microphone a new and useful multi-function push button control by which the user can control predetermined functions with long and/or short presses, and an LED confirmation indicator designed to switch on and off when the user presses the multifunction push button, so the user can know that the pressure on the push button has been effective and has modified the function.

This third embodiment of the invention also incorporates other elements that enable the new communication function between users of different vehicles, or users without a vehicle.

This third embodiment has 3 different variations or versions, which we will call "top range", "medium range" and "low range".

The first version of the third embodiment of the hands-free device, which we will call "top range" comprises two boxes that are visibly identical, left and right. The left-hand box has the electronic circuit board and the left-hand speaker, the electronics in the box being connected to a microphone assembly, which has in turn the microphone, an LED indicator and a multifunction push button. The electronics of the left-hand box is connected to a charger connector with a cable. This version, in addition to the left-hand box, has another box of the same size on the right, connected by a cable. This right-hand box contains the other speaker (right-hand speaker) and a battery. Additionally, the elements in the right-hand box are connected via the corresponding cable to a function switch. The electronics of the left-hand box uses preferably Bluetooth protocol with HFP, HSP and A2DP profiles, with optional mono or stereo selection, vocal response and optionally with automatic volume.

A second version of the third embodiment of the hands-free device, which we will call "mid range" comprises two boxes, the left-hand box contains all the electronics, including the speaker, batteries and the electronic circuit board, connected to a microphone, and the right-hand box only contains a speaker. Like the previous device, the electronics of the left-hand box is connected to a charger connector with a cable. The electronics of the left-hand box uses preferably Bluetooth protocol with HFP and HSP profiles, or Bluetooth protocol with HFP, HSP and A2DP profiles.

A third version of the third embodiment of the hands-free device, which we will call "low range" comprises a single left-hand box, with the same ingredients as the previous version (all the electronics, including the speaker, batteries and the electronic circuit board, connected to a microphone). Like the previous device, the electronics of the left-hand box is connected to a charger connector with a cable. The electronics of the left-hand box uses preferably Bluetooth protocol with HFP and HSP profiles, or Bluetooth protocol with HFP, HSP and A2DP profiles.

In all these three versions of the third embodiment of the hands-free device, both the right and the left-hand box can incorporate means of adherence on the outside of the boxes, such as Velcro.

In these three versions of the third embodiment of the hands-free device, in order to enable the new communication functions, the multi-function switch located on the main unit of the first and second embodiments of the invention is replaced by a multi-function push button on the microphone assembly, with the following functions:

accept a phone call from the exterior, and/or
hang up a call, and/or
activate voice dialing the, and/or
synchronise the device with other equipment (mobile phone, PDA, MP3, GPS . . . ).

The above functions are obtained through a short pressing of the multi-function push button, each pressing will light up the LED to inform the user that the pressure has become an order.

In these three versions of the third embodiment of the hands-free device, the multi-function push button of the microphone assembly additionally incorporates the following functions by means of a long pressure:

On (activation of the hands-free device).
Off (deactivation of the hands-free device).
Association with a Bluetooth terminal.

Likewise each pressing of the multi-function push button will light up the corresponding LED indicator.

This third embodiment of the hands-free device also optionally has, in addition to the LED system, an acoustic confirmation system with different sounds depending on the function activated by the user. All these confirmations of orders by sounds allow the user not to lose sight of the road in front of the vehicle, which is very important when the vehicle is in motion.

Other details and characteristics shall be shown throughout the description below referring to drawings attached to this report which are shown for illustrative but not limiting purposes only in a drawing of the invention.

DESCRIPTION OF THE DRAWINGS

Below is a numbered list for the different parts of the device described, which are indicated in the above drawings; (10) hands-free device in helmet, (11) hands-free device without helmet, (12) body of the main unit, (13) speaker, (14) Velcro, (15) connector, (16) rod, (17) microphone, (18) multi-position switch, (19) perimeter of (12), (20) elastic band, (21) twin core cable, (22) multicore cable, (23) connectors, (24) battery charging connector, (25*a*) "top range" hands-free device, (25*b*) "mid range" hands-free device, (25*c*) "low range" hands-free device, (27*d*) adhesive tape, (28) foam, (29) microphone assembly, (30) multifunction push button, (31) LED indicator, (32) microphone holes, (33*i*) left box, (33*d*) right box, (34*i*) left box speaker, (34*d*) right box speaker, (35) microphone assembly connection tube, (36) power cable, (37) charger connector, (38) function selector, (39) function selector connection cable, (40) charger connector connection tube, (42) battery, (43) printed circuit board.

DESCRIPTION OF A PREFERRED EMBODIMENT OF THE INVENTION

Figure 1:
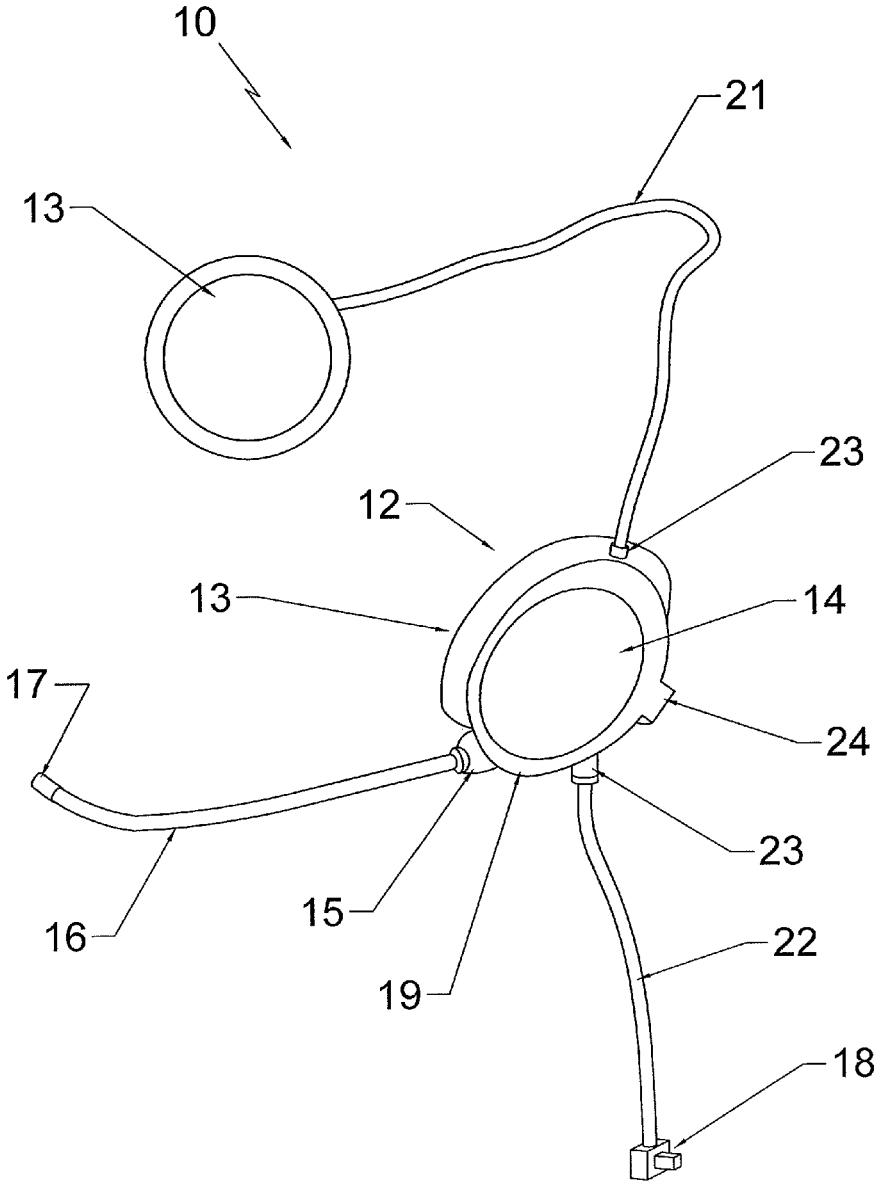
FIG. 1 is a schematic perspective view of the second embodiment of the hands-free device (10) with two speakers, designed for use in a helmet.

In the second preferred embodiment of the invention, as can be seen in the FIG. 1, the hands-free device (10) is comprised of a main unit, the body (12) of which contains a speaker (13) on one of its sides, while the opposite face is covered with an adherent material such as Velcro (14) or similar, an antenna and the electronics for operating the device (10), and on the perimeter of said body (19) and in a lower position, there is a connector (23) and a, multicore cable (22) that connects the body (12) of the main unit to a multi-position switch (18) with the following functions:

On/Off.

Accept/reject call.

Volume

Others (Such as pre-tuning FM radio stations, etc.).

In the main unit and in its body (12) and on its perimeter (19), is the microphone (17) with a rigid rod (16), and with a jack connector (15). If using a full face helmet, the rigid rod (16) can be eliminated, securing the microphone (17) with adherent Velcro type material (14) or similar, connecting the microphone (17) to the (12) main unit with a twin core cable.

The device in this second embodiment incorporates a second speaker on the right (13) with identical features to the first, but without a microphone (17) and rod (16). This second right-hand speaker (13) is connected to the first with a twin core cable (21), and input on the body of the speaker through a jack connector (23).

Both speakers (13), left and right, and the device entire (10) is fitted to the helmet, with Velcro (14) being secured without any sort of studs or similar, staying in the helmet or being removed to fit into another.

To charge the batteries that power the main unit, its body (12) and the perimeter (19) of the same has a mini USB connector (24).

Alternatively, the control module may be physically detached from the body (12) of the device (10) and fitted to the vehicle handlebar, communicating with the main unit by radio frequency.

Figure 2:
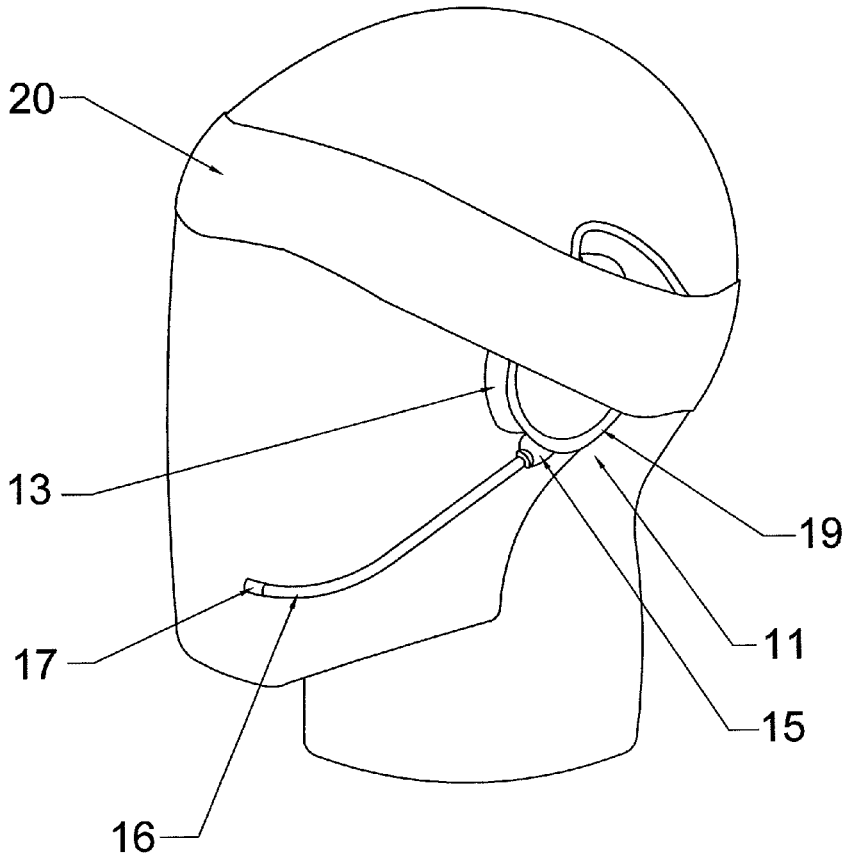
FIG. 2 is a perspective view of a variation of the second embodiment of the hands-free device (10), when it is used without a helmet (12), with the aid of an elastic band (20).

As shown in FIG. 2, if the user practices a sport that does not require the use of a helmet, there is an elastic band (20) to secure the hands-free device (10) to the user's head.

Alternatively and in another possible embodiment, the hands-free device with two speakers (13) of FIG. 1 incorporates a closed protocol wireless chip, but it will not have a Bluetooth chip, so it can be used as a slave receiver in communication between, for example, the pilot and co-pilot.

In the third preferred embodiment of this invention, as may be seen in FIGS. 3-10, the three versions described in the hands-free device patent (25) comprise in all cases the possibility of communication between two or more hands-free devices (25). For this purpose, a flexible connection tube (35) coming out of the left-hand box (33*i*), see FIG. 2, which incorporates a microphone (29) in its end, which has a multi-function push button (30) so the user can select orders by means of two types of pushes, either short or long.

Figure 4:
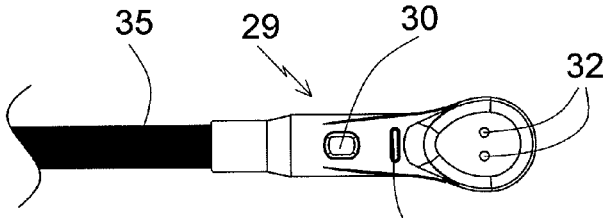
FIG. 4 is a detail view of the microphone assembly (29) of the hands-free device (25*a*) of FIG. 3.

As clearly shown in FIG. 4, the multi-function push button (30), which replaces the multi-function switch of embodiments one and two depicted by number (18), is physically located close to the holes of the microphone (32), with an LED indicator (31) located between these microphone holes (32) and the multi-function push button (30). The mission of this LED indicator is to confirm the user that the pressure on the push button (30) has been effective and has changed the function.

Figure 3:
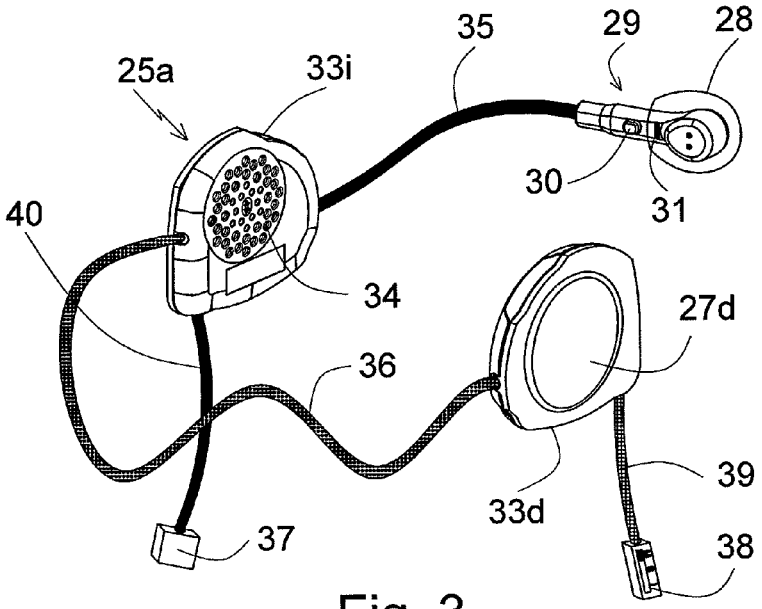
FIG. 3 is a perspective view of the first variation ("Top range") of the third embodiment of the hands-free device (25*a*), which is formed by two identical boxes (33*i*, 33*d*), designed for use inside a helmet using Velcro-type means to secure them (27), which is placed on the outside of both boxes (33*i*, 33*d*).

According to the embodiment of FIG. 3, the first version of the third embodiment of the hands-free device (25*a*), which we will call "Top range", comprises two boxes, identical in appearance (33*i*, 33*d*); left (33*i*) and right (33*d*). The left-hand box (33*i*) has the electronic circuit board (43) and the left-hand speaker (34*i*), the electronics in the box being connected to a microphone assembly (29), the electronics in the box being connected to a charger connector (37) with a cable (40). This version, in addition to the left-hand box, has another box (33*i*) of the same size on the right (33*d*), connected by a flexible cable (35). This right-hand box (33*d*) contains the other speaker (right-hand speaker, 34*d*) and the battery (42*d*). Additionally, the elements contained in the right-hand box are connected with the corresponding power cable (39) to a function selector (38).

According to the embodiment of FIG. 4, in a second version of the hands-free device of the third embodiment which we will call "Mid range" (25*b*), it is formed by two boxes, the left-hand box contains all the electronics including the left-hand speaker (34*i*), the batteries (42*i*) and the printed circuit board (43) and is connected to the microphone assembly (29), while the right-hand box (33*d*) only contains the right-hand speaker (34*d*) and a Velcro type support on the back (27). Like the "Top range" device, the electronics of the left-hand box is connected to a charger connector (37) with a cable (40).

Figure 5:
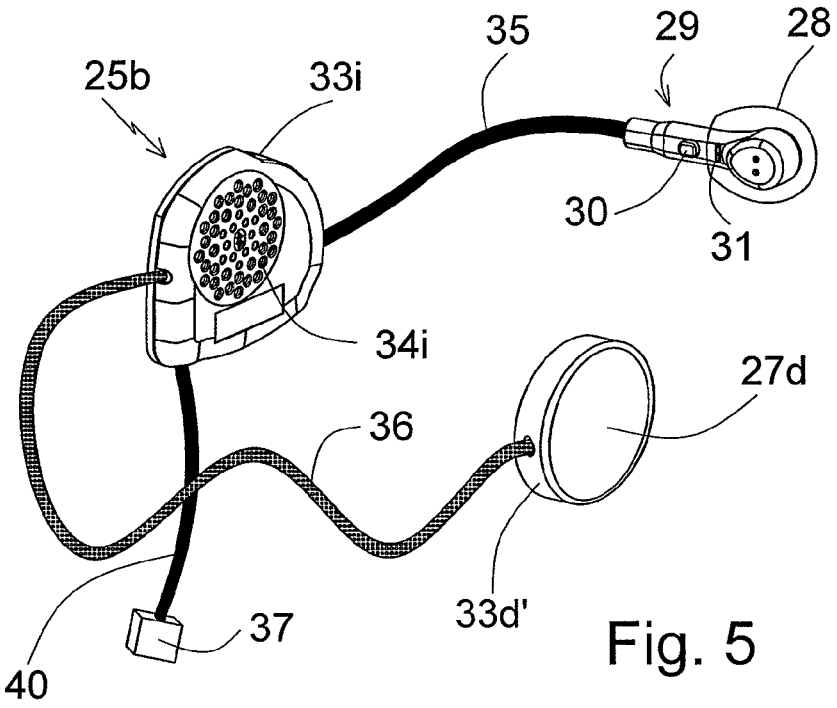
FIG. 5 is a perspective view of the second variation ("Mid range") of the third embodiment of the hands-free device (25*b*), which is formed by a left-hand box (33*i*) and a right-hand element (33*d*').
Figure 6:
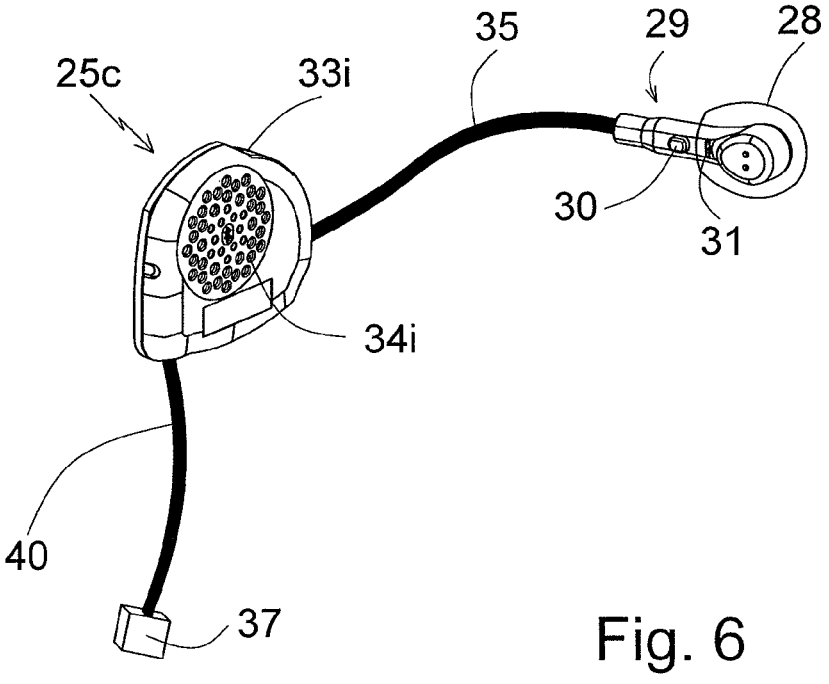
FIG. 6 is a perspective view of the third variation ("Low range") of the third embodiment of the hands-free device (25*c*), which is formed by a single left-hand box (33*i*).
Figure 7:
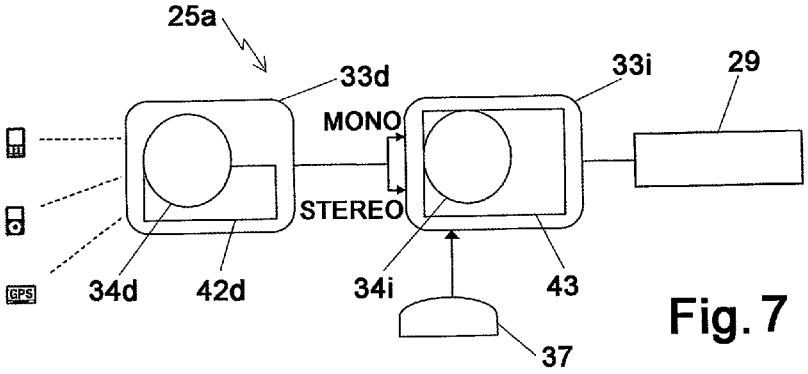
FIG. 7 is a schematic view of the layout of the "Top range" (25*a*) hands-free device of FIG. 3.
Figure 8:
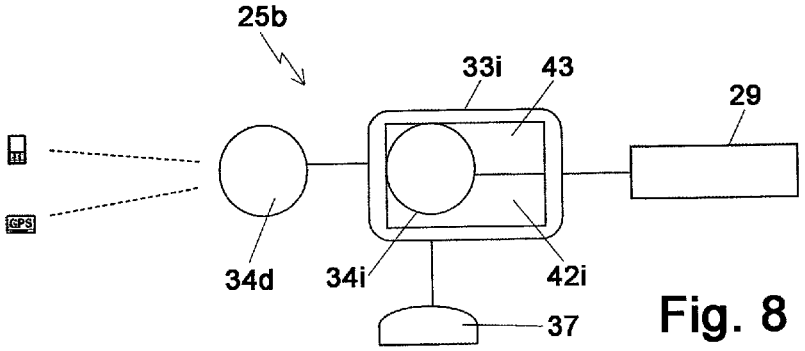
FIG. 8 is a schematic view of the layout of the "Mid range" (25*b*) hands-free device of FIG. 5.
Figure 9:
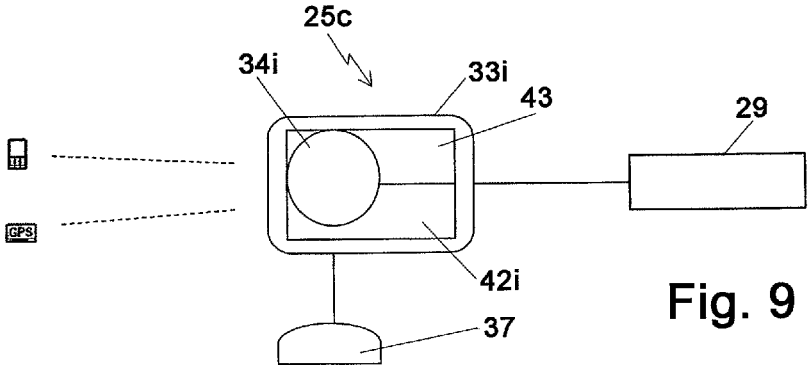
FIG. 9 is a schematic view of the layout of the "Low range" (25*c*) hands-free device of FIG. 6.
Figure 10:
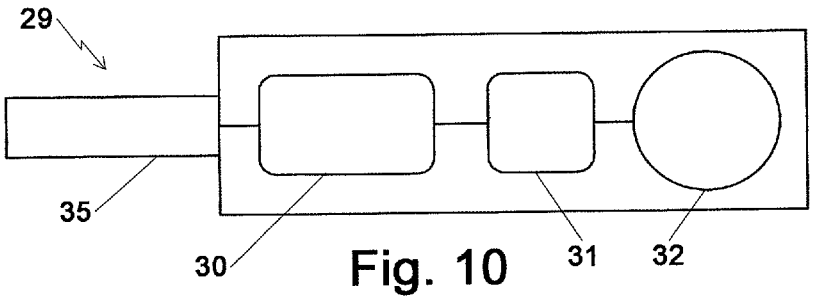
FIG. 10 is a schematic view of the layout of the microphone assembly (29) of FIG. 4.

According to FIG. 5, a third version of the third embodiment of the hands-free device, which we will call "low range", has a single left-hand box, with the same components as the previous version, all the electronics, including the left-hand speaker (34*i*), the batteries (42*i*) and the circuit board (43) connected to the microphone assembly (29). Like the previous device, the electronics of the left-hand box (33*i*) is connected to a charger connector (37) with a cable (40).

Having sufficiently described this invention using the figures attached, it is easy to understand that any modification may be made to the detail which may be deemed to be appropriate, whenever these changes do not alter the scope of the invention summarised in the following claims.

The invention claimed is:

1. "HANDS-FREE DEVICE" formed at least by a speaker (13) which are used inside or over the ear canal, characterized in that the hands-free device (10) is fitted inside a helmet, whatever type of helmet is used, by means of an adherent textile coating on the opposite side of a main unit and its body (12), and in which a microphone assembly (29) is incorporated comprising, in addition to the microphone (17):

a multi-function push button (30) by which the user can control predetermined functions by manually pressing the buttons, and an LED confirmation indicator (31) designed to switch on or off when the user presses the multifunction push button;

characterized in that the multi-function push button works by the user pressing the multi-function push button for long periods offers the following functions:

On;

Off; and

Association with a Bluetooth terminal;

characterized in that the multi-function push button works by the user pressing the multi-function push button for short periods, offers the following functions:

accept a phone call from the exterior;

hang up a call;

activate voice dialing; and synchronize the device with other equipment;

characterized in that both speakers and the entire device are secured to the helmet, using a Velcro type adherent material on one of the sides of the speaker, staying inside the helmet or can be detached and fitted into another helmet.

2. "HANDS-FREE DEVICE" according to claim 1, characterised in that, alternatively, the same hands-free device (10) incorporate, in addition to the first speaker (13), a second speaker (13), with similar features to the first, connected to the first via a twin core cable (21), connecting to the body (12) with a jack (23).

3. "HANDS-FREE DEVICE" according to claim 1, characterised in that if the user is wearing a full face helmet, the device may do without the rod (16), securing the microphone (17) to the inside of the helmet with a Velcro type adherent material, and linked to the main unit with a twin core cable.

4. "HANDS-FREE DEVICE" according to claim 1, characterised in that, alternatively, when the user is not wearing a helmet, the hands-free device (11) can be secured to the user's head with an elastic band (20).

5. "HANDS-FREE DEVICE" according to claim 1, characterised in that the body (12) of the main unit and its perimeter (19) incorporate a mini-USB connector (24) for charging the battery.

6. "HANDS-FREE DEVICE" according to claim 1, characterised in that alternatively, the multi-position switch (18) will be fitted to a control module of the device (10), secured to the handlebar of the vehicle, and connected to the body (12) of the main unit by radio frequency.

7. "HANDS-FREE DEVICE" according to claim 1, characterised in that the multi-function push button works by the user pressing the multi-function push button for short and/or long periods.

8. "HANDS-FREE DEVICE" according to claim 1, characterised in that the hands-free device has additionally a communication function between the device and other hands-free devices of different users physically separated from each other.

9. "HANDS-FREE DEVICE" according to claim 7, characterised in that the hands-free device comprises, according to a first version of the new hands-free device, two visually identical boxes, left and right hand, the left-hand box has a printed circuit board and the left-hand speaker, the electronics in this left-hand box being connected to the microphone assembly, and the right-hand box, which are connected together with a cable, containing the other speaker and a battery.

10. "HANDS-FREE DEVICE" according to the claim 9, characterised in that, additionally, the elements in the right-hand box are connected via the corresponding cable to a function switch.

11. "HANDS-FREE DEVICE" according to claim 9, characterised in that the electronics of the left-hand box uses Bluetooth protocol with HFP, HSP and A2DP profiles, with optional mono or stereo selection, vocal response and optionally with automatic volume.

12. "HANDS-FREE DEVICE" according to claim 1, characterised in that the hands-free device, in accordance with a second version of the new hands-free device, comprises two boxes, the left-hand box contains all the electronics, including the speaker, batteries and the electronic circuit board, connected to a microphone, and the right-hand box only contains a speaker.

13. "HANDS-FREE DEVICE" according to the claim 12, characterised in that the electronics of the left-hand box uses preferably Bluetooth protocol with HFP and HSP profiles, or Bluetooth protocol with HFP, HSP and A2DP profiles.

14. "HANDS-FREE DEVICE" according to claim 1, characterised in that the hands-free device, in accordance with a third version of the new hands-free device, comprises a single left-hand box, with the same components as the previous version (all the electronics, including the speaker, the batteries and the circuit board) connected to the microphone assembly.

15. "HANDS-FREE DEVICE" according to the claim 14, characterised in that the electronics of the left-hand box uses preferably Bluetooth protocol with HFP and HSP profiles, or Bluetooth protocol with HFP, HSP and A2DP profiles.

16. "HANDS-FREE DEVICE" according to claim 1, characterised in that, optionally, the hands-free device of the invention has, in addition to the LED system, an acoustic confirmation system with different sounds depending on the function activated by the user.

17. "HANDS-FREE DEVICE" according to claim 1, characterised in that the electronics of the left-hand box is connected to a charger connector with a cable.

* * * * *